United States Patent [19]

Tami

[11] 4,032,145

[45] June 28, 1977

[54] ACTION BATTER UP GAME APPARATUS

[76] Inventor: Max M. Tami, 1769 Pine St., Napa, Calif. 94558

[22] Filed: Sept. 24, 1975

[21] Appl. No.: 616,141

[52] U.S. Cl. ..... 273/90; 273/26 E

[51] Int. Cl.² ..... A63B 67/10

[58] Field of Search ..... 273/90, 95 A, 98, 97 R, 273/26 E, 58 C, 95 B; 46/77, 51, 52

[56] References Cited

UNITED STATES PATENTS

| | | | |
|---|---|---|---|
| 2,547,776 | 4/1951 | Rankin | 273/26 E |
| 2,561,760 | 7/1951 | Stifter | 46/77 |
| 2,944,817 | 7/1960 | Stiller | 273/58 C |
| 2,947,108 | 8/1960 | Dodd, Jr. et al. | 46/77 |
| 3,376,037 | 4/1968 | Lepselter | 273/95 A |
| 3,540,726 | 11/1970 | Davis | 273/26 E |
| 3,588,104 | 6/1971 | Griffin | 273/26 E |
| 3,731,925 | 5/1973 | Caldwell | 273/26 E |

*Primary Examiner*—Anton O. Oechsle
*Assistant Examiner*—Harry G. Strappello
*Attorney, Agent, or Firm*—Marden S. Gordon

[57] ABSTRACT

An action batter up game apparatus consisting of a baseball affixed at one end of a lengthy nylon cord having a flexible handle affixed to the opposite end, and with there being an elongated hollow open ended cylindrical slide control disposed intermediate the handle and baseball and having the cord passing therethrough.

1 Claim, 2 Drawing Figures

ACTION BATTER UP GAME APPARATUS

BACKGROUND OF THE INVENTION

1. Field of the Invention

This invention relates generally to games and more particularly to a novel action batter up game apparatus to be played by two players in a competitive manner.

2. Description of the Prior Art

The game of baseball is quite popular among individuals of all ages, with the principle disadvantage of the game being that a great number of individuals are required for playing the same, and that when attempting to play the game with but a few individuals it is necessary to continually run around a large area for retrieving the ball each time it is hit by the batter. This running and retrieval soon tires the normal individual who tires of the game so that, even though enjoying playing of the game, the individuals tire rapidly if sufficient individuals are not present to sufficiently cover the playing field area to avoid unnecessary running of but a few individuals.

SUMMARY OF THE INVENTION

The present invention recognizes the popularity of the game of baseball and provides a novel action batter up game apparatus playable by two players where one player serves as the pitcher using a ball tethered to one end of a long nylon cord which is swung about the individual's head while the other player attempts to hit the ball with a conventional baseball bat, control of the ball being by means of a handle and slide control manipulated by the pitcher.

It is a feature of the present invention to provide an action batter up game apparatus.

A further feature of the present invention provides an action batter up game apparatus which is relatively simple in its construction and which, therefore, may be readily manufactured at a relatively low cost and by simple manufacturing methods so that the game apparatus may be retailed at a sufficiently low price to encourage widespread use and purchase thereof among the general public.

Still a further feature of the present invention provides an action batter up game apparatus which is easy to use and reliable and efficient in its operation.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
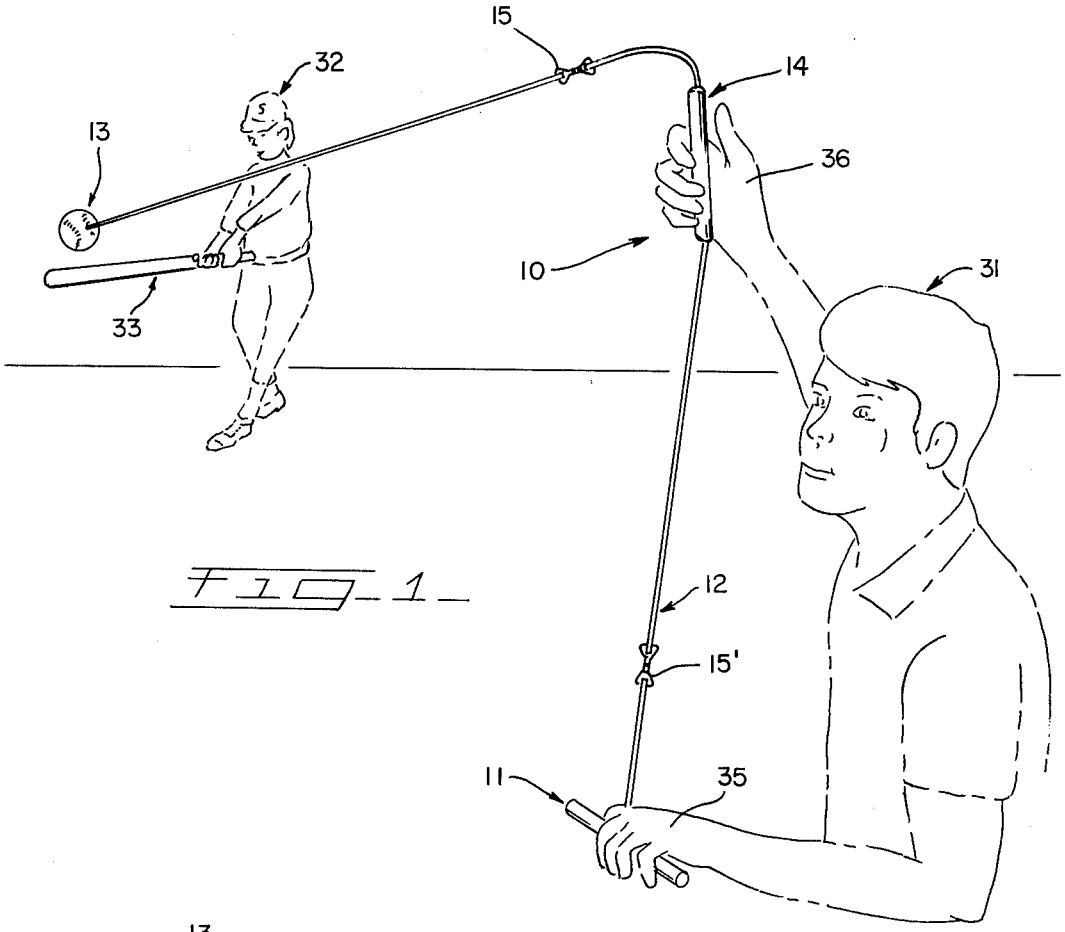
FIG. 1 is a perspective view of a pair of individuals playing with the game apparatus of the invention.
Figure 2:
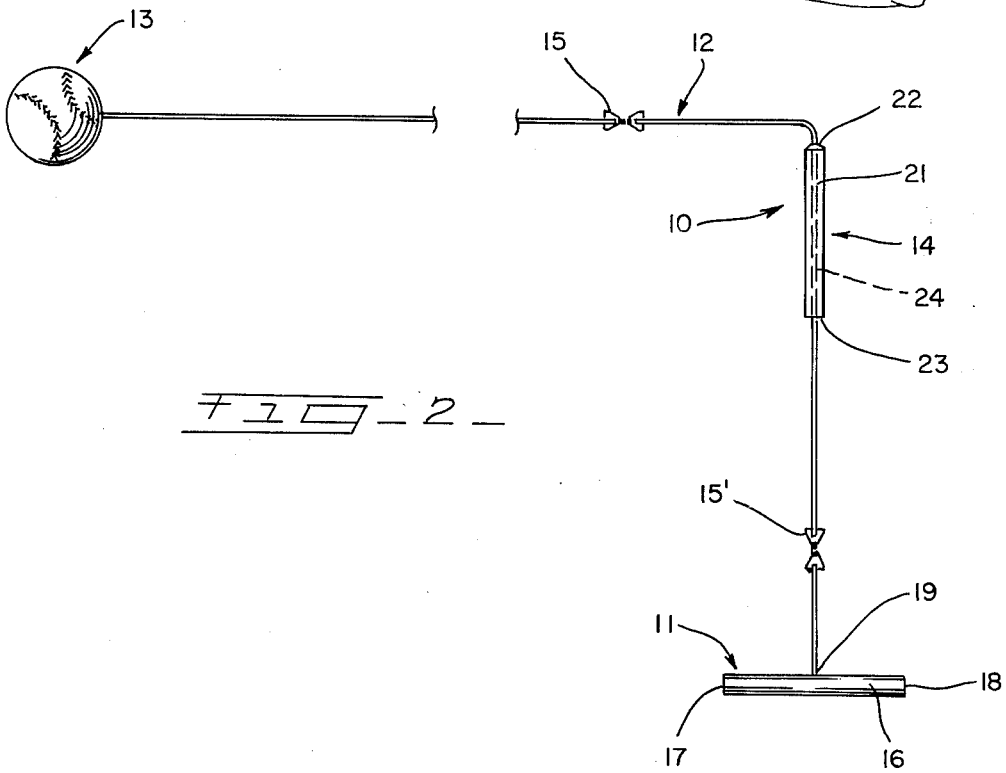
FIG. 2 is a fragmentary top plan view of the game apparatus of the invention.

Referring now to the drawings in detail, there is illustrated a preferred embodiment of an action batter up game apparatus constructed in accordance with the principles of the present invention and designated generally in its entirety by the reference numeral 10 and which is comprised of a handle 11, a cord 12, a baseball 13, a slide control 14, and swivels 15 and 15'.

The baseball 13 may be of a regulation size hard ball or soft ball of conventional dimensions. It is also envisioned that it may be colored fluorescent orange or yellow for evening games.

The cord 12 is of elongated flexible nylon material having one end affixed to ball 13 and the opposite end affixed to flexible handle 11, with intermediate connections to swivel 15 between the slide control 14 and the baseball 13 and to swivel 15' between the slide control 14 and the handle 11.

The flexible handle 11 is of an elongated cylindrical flexible body member 16 having opposite ends 17 and 18 and having the free cord 12 connected to its midpoint 19. The handle 11 is preferably manufactured of a soft flexible plastic material for purposes as will be later described.

The slide control 14 includes an elongated hollow open ended cylindrical body member 21 having top end 22 and bottom end 23 with passageway 24 extending therebetween with cord 12 passing therethrough.

In operation, two players start the game. One player, such as individual 31, is designated as the pitcher with the other player 32 being designated as the batter and using conventional baseball bat 33. The pitcher grips handle 11 in one hand 35 while gripping slide control 14 in his opposite hand 36. The pitcher then swings the ball 13 in a circle over his head with the batter attempting to hit the ball each time it passes by the batter. Upon hitting the ball, the batter 32 must reverse his stance because the pitcher will now pitch the ball in a reverse direction than previously pitched. Each time the ball 13 is hit by batter 32, both the batter and pitcher reverse their direction.

The handle 11 is of soft flexible material since, should the batter 32 miss the ball 13 and chop at the nylon cord 12 striking the same and pulling it in a direction towards the batter, the pitcher 31 need only release the slide control 14 from hand 36 permitting the handle 11 to absorb the shock and thus eliminating any possible injury to the pitcher.

Another function of the handle 11 relative to slide control 14 is to control both inside and outside pitches of the ball 13 by means of pulling the nylon cord 12 through the slide control 14. The slide control 14 can be slid along cord 12 between swivels 15 and 15' so that the pitcher can more easily determine the proper length of cord 12 for inside or outside pitches. A further function of swivels 15 and 15' is to keep cord 12 from twisting and tangling in slide control 14, thus enabling the pitcher to maintain complete control over the baseball 13 at all times. By pulling cord 12 in a downward direction through slide control 14, the pitcher delivers an outside pitch. By extending the nylon cord out through the slide control 14, the pitcher is able to deliver an inside pitch. By combining both features, the pitcher is thus able to deliver any legal type of pitch used in any regulation baseball game.

In scoring, the batter gains one base for hitting the ball. If he then successfully hits the next immediate pitch, he scores a home run. In any event, ten runs wins the game with each miss by tha batter scoring as a strike, three strikes making one out, with each batter allowed three outs at each time at bat.

It is to be understood that the form of this invention as shown and described is to be taken as a preferred example of the invention, and that this invention is not to be limited to the exact arrangement of parts described in the description or illustrated in the drawings as changes thereto as to the details of construction as to size, shape and arrangement of parts may be resorted to without departing from the novel concepts of the invention.

Having thus described the invention, what is claimed is:

1. An action batter up game apparatus comprising, in combination:

a spherical baseball;

a slide control of a size and configuration to be readily grasped in an individual's hand, the slide control consisting of an axially elongated cylindrically shaped body member having an open top end, an open bottom end, cylindrical sidewalls, and an axially elongated passageway extending longitudinally therethrough completely between the open top and bottom ends;

a handle of a size and configuration to be readily grasped in an individual's hand not holding the slide control, the handle consisting of an axially elongated cylindrically shaped body member manufactured of a flexible plastic material the body member having cylindrical side walls and a pair of opposite parallely disposed ends;

a pair of swivel members each identical to each other with each having opposite ends rotatable relative to each other about their longitudinal axis;

each of said swivel members being of a diameter greater than the diameter of the slide control passageway to prevent passage of the swivel members therethrough;

a first length of elongated flexible cord manufactured of nylon material having one end affixed to the spherical baseball at a point on the surface thereof, the opposite end of the cord being connected to one end of a first one of the swivel members;

a second length of elongated flexible cord manufactured of nylon material having opposite ends and having a diameter less than the diameter of the slide control passageway so as to be freely slidable therethrough;

one end of the second cord being connected to the remaining free end of the first one of the swivel members with the opposite end of the second cord being passed freely through the slide control passageway through its open top end and out of its open bottom end, the opposite end of the second cord then being connected to one end of a second one of the swivel members;

the longitudinal overall length of the first cord being greater than the length of the second cord;

a third length of elongated flexible cord manufactured of nylon material having one end connected to the remaining free end of the second one of the swivel members, the opposite end of the third cord being affixed to the flexible handle at a midpoint thereof in a manner projecting generally radially outwardly therefrom;

the overall length of the third cord being less than the length of the second cord and of the first cord; and the disposition of the first and second swivel members serving to define the length of the path of travel of the second cord member through the slide control passageway thus limiting the radial inward and outward movement of the baseball relative to the slide control as manipulated by the individual's operation of the handle.

* * * * *